United States Patent [19]

Boweter

[11] Patent Number: 4,742,835

[45] Date of Patent: May 10, 1988

[54] PERMANENT WAVE ROD

[76] Inventor: Michael Boweter, 970 NW. Garfield, No. 22, Corvallis, Oreg. 97330

[21] Appl. No.: 906,956

[22] Filed: Sep. 15, 1986

[51] Int. Cl.[4] ..... A45D 2/12

[52] U.S. Cl. ..... 132/39; 132/42 R

[58] Field of Search ..... 132/41 B, 42 A, 42 R, 132/40, 41 R, 33 F, 33 G, 39, 41 C; D28/37

[56] References Cited

U.S. PATENT DOCUMENTS

| | | | |
|---|---|---|---|
| D. 185,455 | 6/1959 | McGrath | D28/37 |
| D. 234,323 | 2/1975 | Demi | D28/37 |
| 2,862,508 | 12/1958 | Campbell | D28/37 |

FOREIGN PATENT DOCUMENTS

| | | | |
|---|---|---|---|
| 1810549 | 7/1969 | Fed. Rep. of Germany | 132/39 |
| 3302237 | 7/1984 | Fed. Rep. of Germany | 132/39 |
| 403,479 | 11/1909 | France | 132/42 A |
| 2032772 | 5/1980 | United Kingdom | 132/40 |

*Primary Examiner*—Robert P. Swiatek
*Assistant Examiner*—Cary E. Stone
*Attorney, Agent, or Firm*—Chernoff, Vilhauer, McClung & Stenzel

[57] ABSTRACT

The permanent wave rod of the present invention is comprised of an elongate body having an oblong cross-sectional shape wherein the diameter of the circular segment at the narrower top of the rod is 0.4 to 0.8 times the diameter of the circular segment at the wider bottom of the rod. The circular segments are intersected by sides which are tangential with both of the circular segments. The centers of the circular segments are offset from one another by a distance which is equal to one-half of the diameter of the larger circular segement. The cross-sectional dimensions of the rod vary along its longitudinal extent with the center of the rod being approximately one-half of the size of its extremities. In addition, the center of the rod is axially offset from its extremities towards the larger circular segment.

2 Claims, 1 Drawing Sheet

PERMANENT WAVE ROD

BACKGROUND AND SUMMARY OF THE INVENTION

This invention relates to a permanent wave rod and in particular to a permanent wave rod which creates a variable wave pattern that closely resembles naturally curly hair.

In order to make straight hair curly, it is wound around permanent wave rods and then treated with a permanent wave solution. The most common of these rods is in the shape of an elongate cylinder, which creates a wave which is quite dissimilar from naturally curly hair. This is because the wave in naturally curly hair is uneven with tight and loose waves being arranged in a varying pattern. Cylindrical rods, on the other hand, whether a straight cylinder or a varying cross-sectional cylinder, impart a uniform wave to hair curled on them.

Volz, German Patent No. 3302237, provides a permanent wave rod with an oblong cross section which creates an uneven wave which more closely approximates naturally curly hair. However, the rod of Volz causes too much wave variation, and imparts very tight waves to the sections of hair which pass over its narrow top portion. In addition, hair curled on the rod of Volz has unnaturally long, straight or relatively straight sections as a result of the relatively long flat sides of the rod. Thus, hair curled on Volz' rods still does not approximate naturally curly hair very closely.

The permanent wave rod of the present invention overcomes the shortcomings of the prior art permanent wave rods by providing an oblong cross-sectioned rod which has a circular segment at its top with a diameter d which is between 0.4 and 0.8 of the diameter D of the circular segment at its bottom. Thus, waves formed at both the top and bottom of the rod are within the range of naturally curly hair, although they are at its extremities, thereby giving a naturally curly look.

In addition, the center of the circular segment at the top of the rod is located on the periphery of the circular segment at the bottom of the rod. Thus, the sides of the rod, while straight, are relatively short compared to the lengths of the circular segments so that there are no straight sections of hair resulting with the use of the rod.

Finally, the center of the rod is approximately one-half of the size of its extremities and its center is axially offset from its extremities, both of which add to wave variation in hair curled with the rod and results in hair which more closely approximates naturally curly hair.

Accordingly, it is a principal object of the present invention to provide a permanent wave rod which curls hair in an uneven manner which approximates naturally curly hair.

It is a further object of the present invention to provide a permanent wave rod which is oblong with the diameter of the circular segment at the top of the rod being 0.4 to 0.8 times the diameter of the circular segment of the bottom of the rod.

The foregoing and other objectives, features and advantages of the present invention will be more readily understood upon consideration of the following detailed description of the invention taken in conjunction with the accompanying drawings.

PREFERRED EMBODIMENT OF THE INVENTION

Figure 1:
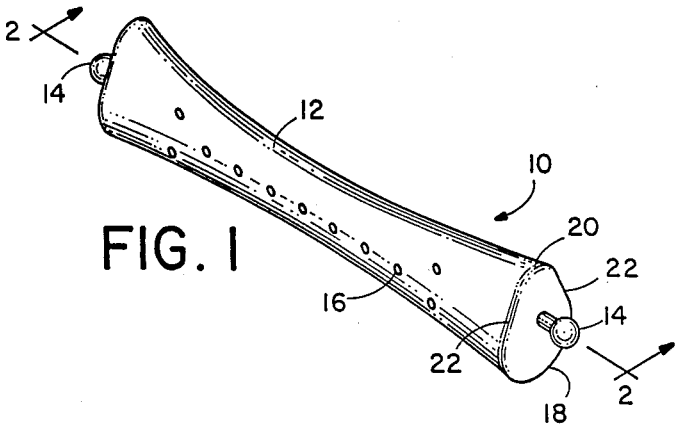
FIG. 1 is a pictorial view of a permanent wave rod embodying the features of the present invention.
Figure 2:
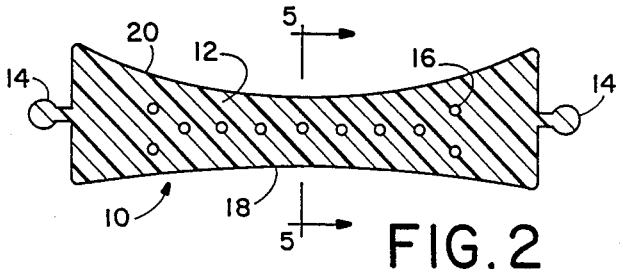
FIG. 2 is a sectional view taken along the line 2—2 in FIG. 1.

Referring to FIG. 1 of the drawings, the permanent wave rod 10 of the present invention comprises an elongate body 12 having bulbous extensions 14 at each of its ends. An elastic band (not shown) extends between the two extensions 14 to maintain the rod in place on a section of hair which is wrapped around it. The rod also has a plurality of holes 16 located in it to receive permanent wave solution. If desired, the surface of the rod can be dimpled to engage the hair as it is being wrapped.

Figure 6:
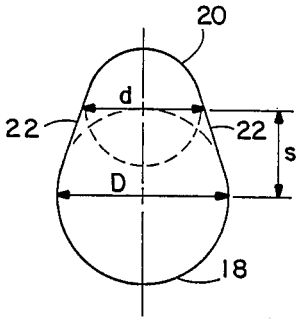
FIG. 6 is a diagrammatic view showing the details of the cross-sectional shape of the rod.
Figure 3:
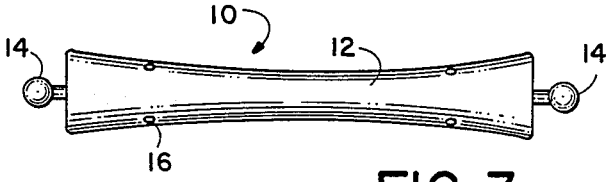
FIG. 3 is a plan view of the rod of FIG. 1.
Figure 4:
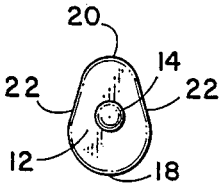
FIG. 4 is an end elevation view of the rod of FIG. 1.
Figure 5:
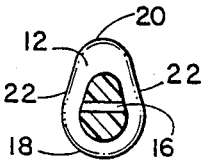
FIG. 5 is a sectional view taken along the line 5—5 in FIG. 1.

Referring to FIG. 6, the rod has a cross-sectional shape which is characterized by a first circular segment 18 having a diameter D and a second circular segment 20 having a smaller diameter d. The centers of the first and second circular segments are offset from one another by a separation distance s, and they are interconnected by sides 22 which contact the circular segments at points where they are tangent to them. In order to create a wave which has a natural curly look the ratio of the diameters d/D must be between 0.4 and 0.8. If the ratio d/D exceeds 0.8 the rod will form uniform-sized waves, and, due to the separation of the two circular segments, the wave will have a Z shape. Conversely, if the ratio d/D falls below 0.4 the resulting wave will be too tight where the hair contacts the second circular segment and a kinky wave will result. For most applications optimum results are achieved with the diameter ratio d/D equal to approximately 0.7.

In order to create the maximum wave variation, the size of the rod varies along its linear extent with the maximum cross-sectional dimensions occurring at each of the extremities of the rod and the minimum cross-sectional dimensions occurring at its midpoint. In the preferred embodiment illustrated, the dimensions at the middle of the rod are approximatley one-half of the corresponding dimensions at its extremities.

Rather than the center of the rod being concentrically aligned with its extremities, it is offset toward the first circular segment. Thus, looking toward one of its sides 22 the curvature at the top of the rod is greater than the curvature at the bottom of the rod.

The permanent wave rod of the subject invention is used in the same manner as the prior art rods. However, rather than giving a uniform wave it gives a wave which alternately is tight and loose. The particular ratio of the first and second diameters and the size relationship between the extremities of the rod and its midpoint provide a wave pattern which closely approximates that of naturally curly hair.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A permanent wave rod comprising an elongate body having a cross-sectional shape characterized by a first circular segment having a diameter D, and a second circular segment having a diameter between 0.4 D and 0.8 D and having its center spaced apart from the center of said first circular segment by a distance equal to approximately D/2, and paired sides which tangentially intersect both circular segments, wherein the cross-sectional dimensions of the rod intermediate its extremities is approximately one-half of the cross-sectional dimensions at its extremities and wherein the cross section of the rod intermediate its extremities is not concentric with the cross section of the rod at its extremities.

2. The rod of claim 1 where the cross section of the rod intermediate its extremities is off-set towards said second circular segment relative to the cross section of the rod at its extremities.

* * * * *